US012679521B2

(12) United States Patent
Conti et al.

(10) Patent No.: US 12,679,521 B2
(45) Date of Patent: Jul. 14, 2026

(54) HYBRID PROPULSION SYSTEM FOR A PLEASURE BOAT

(71) Applicant: PUNCH TORINO S.P.A., Turin (IT)

(72) Inventors: Antonino Conti, Turin (IT); Riccardo Rossi, Turin (IT); Mirco Brero, Turin (IT); Franco Oberti, Turin (IT); Massimiliano Melis, Turin (IT)

(73) Assignee: PUNCH TORINO S.P.A., Turin (IT)

( * ) Notice: Subject to any disclaimer, the term of this patent is extended or adjusted under 35 U.S.C. 154(b) by 411 days.

(21) Appl. No.: 18/276,642

(22) PCT Filed: Mar. 4, 2022

(86) PCT No.: PCT/IB2022/051922
§ 371 (c)(1),
(2) Date: Aug. 10, 2023

(87) PCT Pub. No.: WO2022/185267
PCT Pub. Date: Sep. 9, 2022

(65) Prior Publication Data

US 2024/0132192 A1 Apr. 25, 2024
US 2024/0228002 A9 Jul. 11, 2024

(30) Foreign Application Priority Data

Mar. 5, 2021 (IT) ..... 102021000005261

(51) Int. Cl.
*B63H 21/20* (2006.01)
*B63B 79/10* (2020.01)
(Continued)

(52) U.S. Cl.
CPC ..... *B63H 21/20* (2013.01); *B63B 79/10* (2020.01); *B63H 25/42* (2013.01); *B63H 2020/003* (2013.01); *B63H 2021/205* (2013.01)

(58) Field of Classification Search
CPC .. B63H 21/20; B63H 25/42; B63H 2020/003; B63H 2021/205; B63B 79/10
See application file for complete search history.

(56) References Cited

U.S. PATENT DOCUMENTS 10,822,068 B2 * 11/2020 Mikalsen ..... B63H 21/20
2020/0140052 A1 * 5/2020 Derginer ..... B63H 25/42

FOREIGN PATENT DOCUMENTS

EP 3722201 A1 * 10/2020 ..... B63H 25/42
IT 202100005261 A1 * 9/2022 ..... B63H 25/42
(Continued)

*Primary Examiner* — Marc Q Jimenez
*Assistant Examiner* — Jovon E Hayes
(74) *Attorney, Agent, or Firm* — R. Ruschena Patent Agent, LLC

(57) ABSTRACT

A hybrid propulsion system for a pleasure boat provided with a control system of the hybrid propulsion system and of the position of the boat, the hybrid propulsion system further comprising an internal combustion engine and an electric motor/generator operating in an integrated manner and according to two operating modes managed by the control system, In which—the control system is configured to control the position of the boat by means of signals from a plurality of gyroscopic sensors and/or triaxial accelerometers, and—the plurality of gyroscopic sensors and/or triaxial accelerometers is located such that there is at least one gyroscopic sensor and/or one triaxial accelerometer at the bow of the boat and at least one gyroscopic sensor and/or one triaxial accelerometer at the stern of the boat.

9 Claims, 4 Drawing Sheets

(51) Int. Cl.
*B63H 25/42* (2006.01)
*B63H 20/00* (2006.01)

(56) References Cited

FOREIGN PATENT DOCUMENTS

| | | | | | |
|---|---|---|---|---|---|
| JP | 2018099903 | A | * | 6/2018 | ..... B63H 25/42 |
| JP | 2022068615 | A | * | 5/2022 | ..... B63H 21/21 |
| WO | WO-2019157400 | A1 | * | 8/2019 | ..... G05D 1/0206 |

* cited by examiner

HYBRID PROPULSION SYSTEM FOR A PLEASURE BOAT

BACKGROUND OF THE INVENTION

1. Field of the Invention

The present invention relates to a hybrid propulsion system for a pleasure boat equipped with a control system for the hybrid propulsion system and the position of the pleasure boat. In particular, the hybrid propulsion system comprises an internal combustion engine and an electric motor/generator assisted by one or more supply batteries, while the control system also comprises a plurality of gyroscopic sensors and/or triaxial accelerometers and the control of the position is based on signals from the plurality of gyroscopic sensors and/or triaxial accelerometers.

The two-mode hybrid propulsion system allows the user of the pleasure boat to navigate in cruise mode with only the internal combustion engine but also to navigate with only the electric motor at low speed and with zero polluting emissions. In addition, the position control system allows the ability to maintain (or control) the position of the boat under various operating conditions.

The invention was conceived for the application of the hybrid propulsion system in the so-called "outboard" position, but it is understood that the same inventive solution can be applied to medium and small boats equipped with an inboard propulsion system.

2. Brief Description of the Prior Art

As is known, pleasure boating is navigation in maritime waters for sporting or recreational purposes or, more generally, for non-commercial purposes carried out on board of boats. The propulsion of these means is generally carried out with outboard motors or marine engines mounted in the transom of medium and small boats. Historically, the engines used are two or four-stroke internal combustion engines, both petrol and diesel.

As is known, however, internal combustion engines, using fossil fuels, contribute to environmental pollution. Due to this limitation, models equipped with an electric motor have been placed on the market for several years. Even electric propulsion, however, has its drawbacks essentially linked to navigation autonomy and battery recharging times.

In addition, the user of pleasure boats is interested in both zero-emission propulsion and the emulation of anchoring maneuvers, that is, making the boat stop without the need of the anchor. Therefore, all this requires the installation of an auxiliary electric motor equipped with adequate position control.

To avoid the installation of an auxiliary electric motor, boats with hybrid propulsion systems have been proposed in different configurations, but almost always inboard.

In addition, systems for controlling the position of a pleasure boat based on signals from sensors operating in GPS (Global positioning System) mode are known. However, these systems, which have recently developed thanks to GPS satellite technology, do not allow precise positioning for a variety of reasons. First, they lose their effectiveness in areas where the GPS signal is weak or completely absent. Secondly, if the vessel develops tension between the bow and stern, the GPS signal fails to take this into account and the information provided is inaccurate. Thirdly, a GPS signal, which is a punctual signal, is equally unable to evaluate and therefore compensate for the effect of the sea wave. Finally, a control system based on GPS technology requires a significant electricity requirement.

It should be emphasized that the precise control of the position of a boat is very important and is necessary in many situations: first of all if you intend to stop the boat in the open sea without having to resort to an anchoring maneuver (need, as already mentioned, much felt by yachtsmen); position control is also important during access maneuvers to protected areas/ports; finally, in the practice of trolling it is equally important to maintain a low speed by controlling the relative position of the boat.

Therefore, there is a need to define an innovative hybrid propulsion system for pleasure boats equipped with a boat position control system, a control system that is free from or at least minimizes the aforementioned drawbacks.

SUMMARY OF THE INVENTION

In order to substantially solve the technical problems highlighted above, an object of the present invention is to define a hybrid propulsion system for a pleasure boat provided with a control system configured to control the hybrid propulsion system and the position of the boat by means of signals coming from a plurality of gyroscopic sensors and/or triaxial accelerometers. The use of these sensors, suitably located so that there is at least one in the bow and at least one in the stern, allows a much more precise position control than a position control according to the known technique, as it is possible to evaluate and therefore result compensate for both a possible state of tension between the bow and stern of the boat and the effect of sea waves.

Advantageously, the control of the position of the boat can be carried out in different operating conditions of the boat. For example, during a mooring maneuver in port or at anchor, or to emulate an anchoring maneuver in the open sea or during a trolling maneuver.

Preferably, the hybrid propulsion system comprises an internal combustion engine and an electric motor/generator which operate in a controlled and integrated manner and in two different modes. In particular, the internal combustion engine will be able to operate during the cruise operating mode and in this mode the electric motor/generator will act as an electric generator to power the onboard accessories and to recharge the batteries.

Conversely, during low-speed operating mode, the internal combustion engine will be shut down and the electric motor/generator will operate in electric motor mode to ensure low-speed, zero-emission propulsion.

Preferably the plurality of gyroscopic sensors and/or triaxial accelerometers is configured to operate in wi-fi mode, thus considerably simplifying the on-board electrical wiring.

Advantageously, the control system may also include at least one sensor that detects the angle of the wind.

Therefore, according to the present invention there is provided a hybrid propulsion system for a pleasure boat comprising a control system configured to control the hybrid propulsion system and the position of the pleasure boat, the hybrid propulsion system having the stated characteristics in the independent product claim annexed to the present description.

Further preferred and/or particularly advantageous embodiments of the invention are described according to the characteristics set out in the attached dependent claims.

BRIEF DESCRIPTION OF THE DRAWINGS

The invention will now be described with reference to the attached drawings, which illustrate some non-limiting examples of implementation, in which.

FIGS. Ia and Ib are schematic representations of a pleasure boat equipped with gyroscopic sensors and/or triaxial accelerometers, according to a first and a second embodiment of the present invention.

DETAILED DESCRIPTION OF THE INVENTION

Figure 1A:
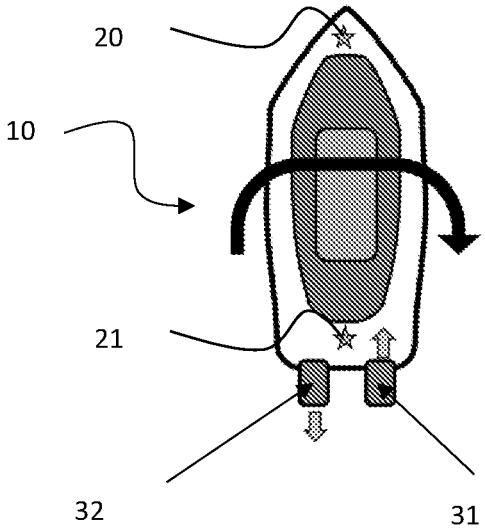

Some terminological premises seem due for the sake of clarity.

In the course of this description, the terminology "pleasure boat" will often be used, including the term "small recreational boat". As is known, the term pleasure boat includes units between 10 and 24 meters, both motor and sailing, while the term small recreational boat includes all pleasure boats of less than 10 meters length, used both in waters maritime and inland waters, both motor and sailing, as well as all rowing boats. In order not to burden the present description, it is preferred to use only the term "pleasure boat" but with the caveat that the scope of the present invention includes all the applications of a hybrid propulsion system for motorized pleasure boats below the 24 meters long.

Furthermore, the terminology "gyroscopic sensor and/or triaxial accelerometer" will be used in this description. Although this terminology is known to technicians in the sector, it is preferable to remember that gyroscopic sensors and accelerometers are electro-mechanical sensors, so-called MEMS (from the English, acronym for Micro-Electro-Mechanical System). More precisely, the gyroscopic sensor is a sensor which measures the rotational motion and in particular detects the slightest variations in the angular velocity of a given object. A triaxial accelerometer, on the other hand, is able, along three main axes, to detect and/or measure the acceleration, calculating the force detected with respect to the mass of the object.

In the description of the hybrid propulsion system, an "electric motor/generator" will often be mentioned, meaning by this term an electric machine capable of operating both as a driving machine and as an operating machine. Even when, for the sake of brevity, we write more simply "electric motor", it will be understood that this machine can also perform the function of electric generator under appropriate conditions.

Finally, with the term "trolling" we mean the technique of sport fishing in a boat which consists of navigating by pulling lures or live fish with the use of special rods.

Purely by way of non-limiting example, the present invention will now be described with reference to the aforementioned figures.

In particular, FIGS. Ia and Ib illustrate a pleasure boat 10, as previously defined. The pleasure boat 10 is equipped with at least one hybrid propulsion system, according to the present invention, in turn comprising a control system of the hybrid propulsion system and the position of the boat, as will be explained below. The control system is also provided with a plurality of gyroscopic sensors and/or triaxial accelerometers 20, 21, located along the boat but in such a way that there is at least one gyroscopic sensor and/or a triaxial accelerometer 20 in the bow of the boat 10 and at least one gyroscopic sensor and/or triaxial accelerometer 21 at the stern of the boat 10.

The plurality of gyroscopic sensors and/or triaxial accelerometers, generally provided with suitable wiring, can be configured to operate in wi fi mode, thus simplifying the on-board wiring.

This plurality of sensors provides the position of the pleasure boat to the control system which will implement the desired position by means of two electric motors 31, 32 (FIG. Ia, configuration with two hybrid propulsion systems) or a single electric motor 30 (FIG. Ib, configuration with a hybrid propulsion system).

In the first case, the electric motors 31, 32 provide a propulsive thrust along the same direction (the direction joining the bow with the stern of the boat) but opposite to each other. In this way it will be possible to control forward travel (with the first electric motor 31), reverse travel (with the second electric motor 32) but also a rotary motion, when, for example, the propulsive thrust of the first electric motor 31 is greater than the propulsive thrust of the second electric motor 32.

In the second case, the electric motor 30 is unique and is able to implement a propulsive thrust directed so as to ensure forward travel, reverse travel and rotation of the pleasure boat 10.

Figure 2:
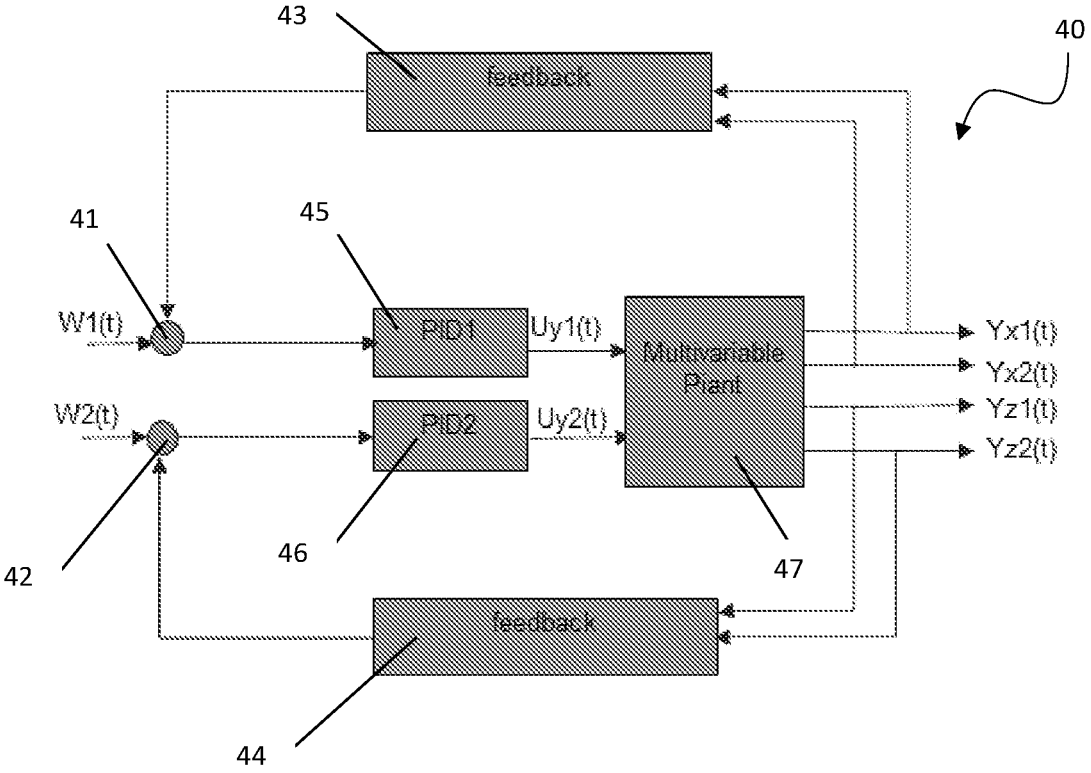
FIG. 2 is a block diagram of the boat position control system in FIG. Ia in cases of emulation of the anchoring maneuver and the execution of a trolling maneuver.

With reference to FIG. 2, an exemplary configuration of the control system 40 of the position of the pleasure boat 10 is schematized with a sequence of logic blocks. In particular, FIG. 2 is a block diagram of the control system 40 of the position of the pleasure boat 10 of FIG. Ia (i.e., with the two electric motors 31, 32) in the cases of emulation of the anchoring maneuver or control of the route, for example in the execution of a trolling maneuver.

In the block diagram of the control system 40 the logic blocks 41, 42 compare the set-point signals with the feedback signals coming from corresponding feedback blocks 43, 44, the regulators 45, 46 (preferably of the type "proportional-integral-derivative" or PID) determine on the basis of the value of the variable to be regulated the value of the regulating variable and the control unit 47 transforms the values of the regulating variable into input values for the electric motors. In the cases of emulation of the anchor maneuver or the course control, the set-points W1 and W2 are static and are angular values and also the signals coming from the feedback blocks 43, 44 are angular values. The logic blocks 41, 42 compare the set-point signals with the feedback signals and transmit the errors (i.e. the angular differences between the set-point value and the feedback value) to the regulators 45, 46. The latter will transmit the values of the regulating variable Uy1, Uy2 (for example a driving torque) to the control unit 47, which in turn will command the two electric motors to deliver a propulsive thrust Yx1, Yx2 and Yz1, Yz2 according to two directions defined by components x and z of the displacement vector.

The control unit 47 receives and processes the reading of at least two gyroscopic sensors and/or triaxial accelerometers that provide data on the variations of the x and z components of the displacement vector. These variations are the input data of the feedback blocks 43, 44 which calculate the compensated angle to keep the error at zero and keep the pleasure boat 10 in the same position or course.

Figure 1B:
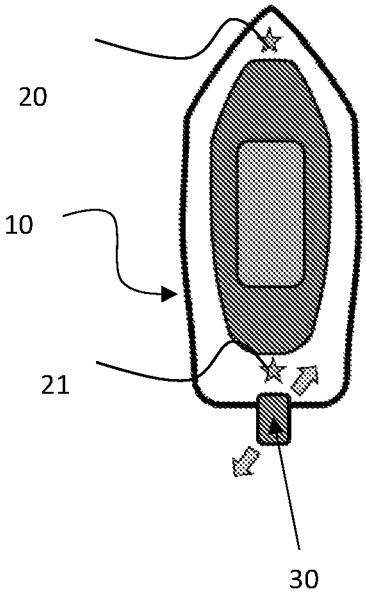

In the configuration of FIG. 1*b*, with a single electric motor, the control system operates in the same way working with a single set-point block, a single feedback block, a single PID regulator and the control unit. In this configuration, the control of the electric motor will also act on its pivot angle, so that the electric motor can impart the propulsive thrust along any direction, to make changes in the orientation of the pleasure boat.

Figure 3:
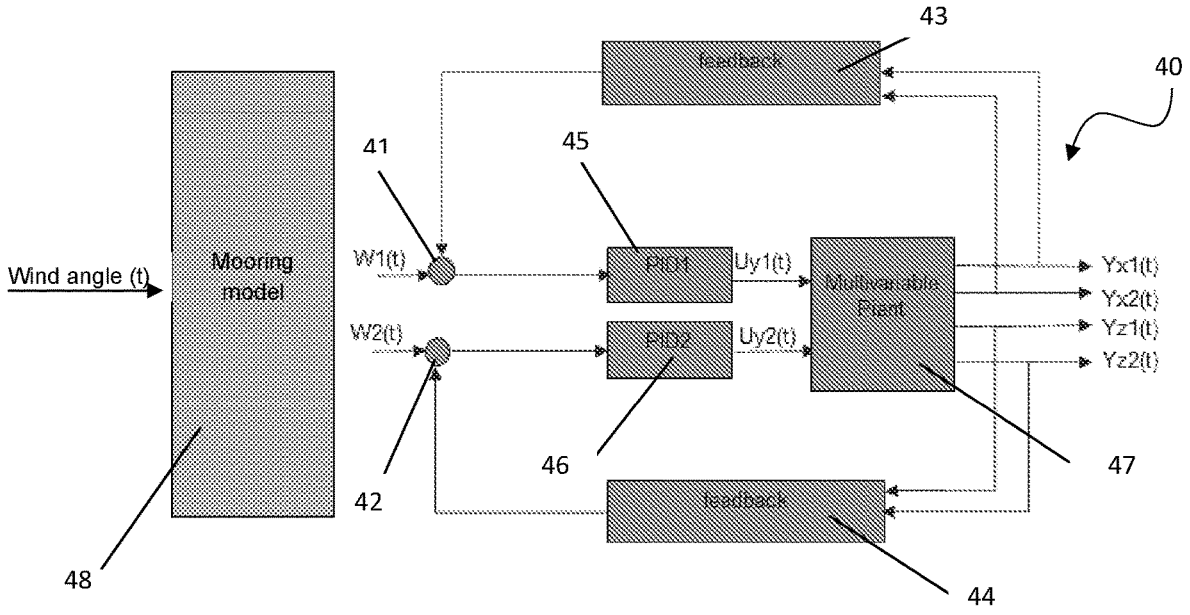
FIG. 3 is a block diagram of the boat position control system of FIG. Ia in the case of performing a mooring maneuver in port or in the roadstead, FIG. 4 schematically illustrates a first embodiment of the hybrid propulsion system of the boat of FIG. 1*b*, FIG. 5 schematically illustrates a second embodiment of the hybrid propulsion system of the boat of FIG. 1*b*, FIG. 6 schematically illustrates a first operating mode of the hybrid propulsion system of FIG. 4, and FIG. 7 schematically illustrates a second operating mode of the hybrid propulsion system of FIG. 4.

FIG. 3 is a block diagram of the boat position control system of FIG. Ia in the case of performing a mooring maneuver in port or in the roadstead. As can be seen, the block diagram coincides with that of FIG. 2 previously described and operates in the same way both in the configuration with two electric motors and in the configuration with a single electric motor. To describe the simulated control of the mooring maneuver, the angular values w1 and w2 are no longer static but are dynamic and will be calculated by the mooring model 48 which receives the wind angle as input. The mooring model 48 evaluates the leeway in mooring conditions in order to produce as output two angles w1, w2 which are the dynamic set-points for position and course control. In this way, the control will emulate the boat sway to leeward of the anchor. The wind direction can be entered manually by the user or, advantageously, can be automatically supplied to the mooring model 48 by means of a suitable wind sensor, of a known type and therefore not shown in FIG. 3.

Figure 4:
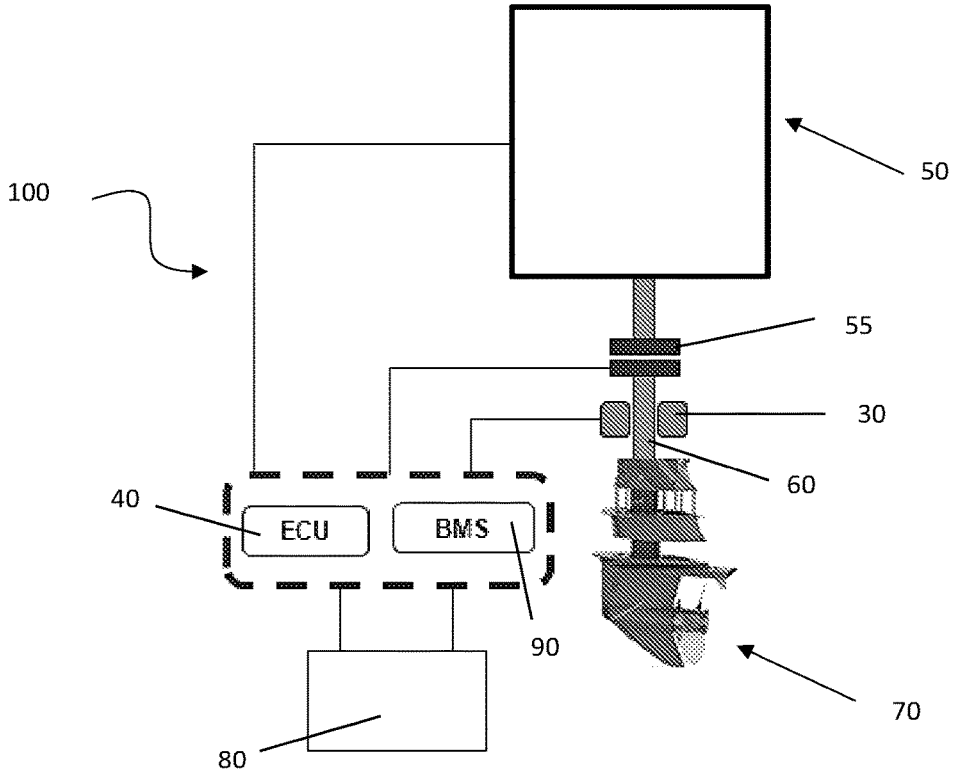

With reference to FIG. 4, the hybrid propulsion system 100 is a preferably outboard solution comprising an internal combustion engine 50 and an electric motor/generator 30 of low power. The hybrid propulsion system may be completely new, as well as a retrofit solution consisting in the installation of the additional electric motor to an existing architecture with only the internal combustion engine. In any case, the hybrid configuration does not require any special transmission as it is sufficient to provide a toothed clutch 55, interposed between the internal combustion engine 50 and the electric motor generator 30 and which, depending on the operating mode, can mechanically couple the thermal engine to the electric motor or, on the contrary, uncouple them. A vertical drive shaft 60 connects the internal combustion engine 50 and the electric motor 30 to a propeller 70. In addition, the hybrid propulsion system will be equipped with one or more batteries 80 that power the electric motor in the case of purely electric propulsion. Internal combustion engine, toothed clutch and electric motor/generator are managed by the control system 40 (previously described), while the battery or the battery pack 80 are managed by a "battery management system" 90. In this configuration, the electric motor/generator 30 is installed in the lower part of the vertical drive shaft 60. The size of the electric motor depends on the applications and the size of the pleasure boat: in general, a range of 3 to 10 kW is suitable for a pleasure boat. In case more electric power is needed, it will be possible to install two hybrid propulsion systems, preferably both outboard.

In the event that the pleasure boat requires more than two outboard engines to achieve the required performance (for example, three or even four engines), two hybrid propulsion systems and one or two additional internal combustion engines can be provided. In other words, for the purposes of the present invention, the hybrid propulsion systems according to the present invention may be one or two in number. Furthermore, the values of the powers involved are completely scalable.

The size of the battery or battery pack will depend on numerous factors: the size of the pleasure boat, the size of the electric motor or electric motors, the required performance and the desired cruising range in electric-only operating mode, i.e., emissions zero.

Figure 5:
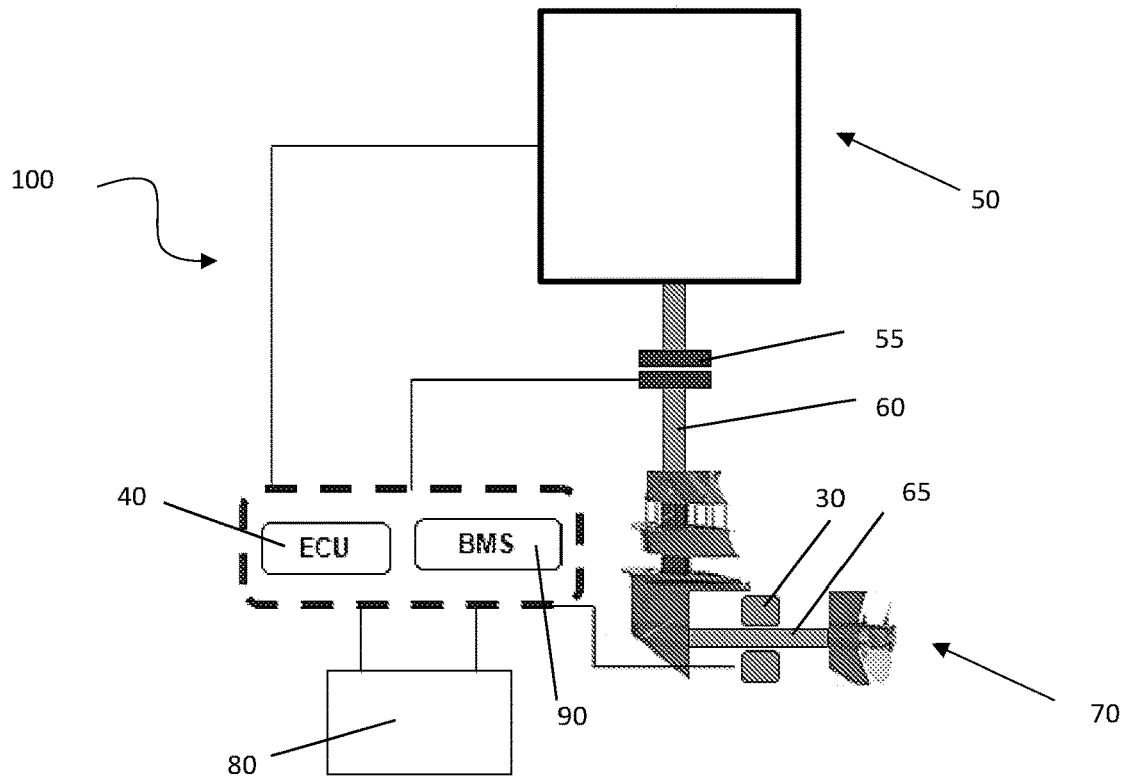

FIG. 5 schematically illustrates a second embodiment of the hybrid propulsion system 100 in which the transmission of motion to the propeller 70 is carried out by means of a first vertical drive shaft 60 and a second horizontal drive shaft 65, between them connected in a known way (for example by means of a bevel pair of gears), and in this configuration the electric motor generator 30 can also be mounted on the horizontal drive shaft 65.

Figure 6:
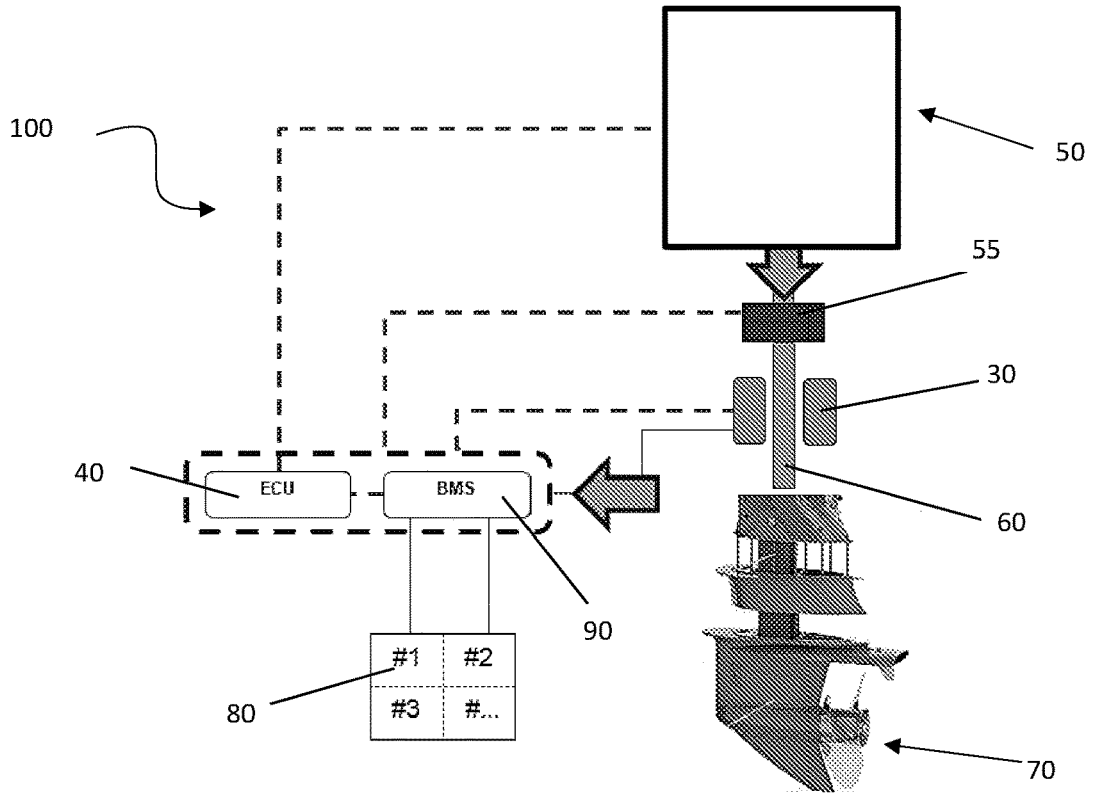

With reference to FIG. 6, a first operating mode of the hybrid propulsion system 100 is described, for example in the configuration of FIG. 4. According to this first operating mode, at cruising speed or close to cruising speed, the propulsion of the boat from pleasure is completely supplied by the internal combustion engine 50. During this operating mode, the electric motor/generator 30 can function as an electric generator and can be disengaged or engaged, by means of the toothed clutch 55, depending on the state of charge of the battery pack 80. In FIG. 6, the toothed clutch 55 is shown engaged and, therefore, the electric motor is operating as an electric generator. Once the user has selected the cruise operating mode, the control system 40 activates the toothed clutch 55 and controls the electric motor 30 as needed.

Figure 7:
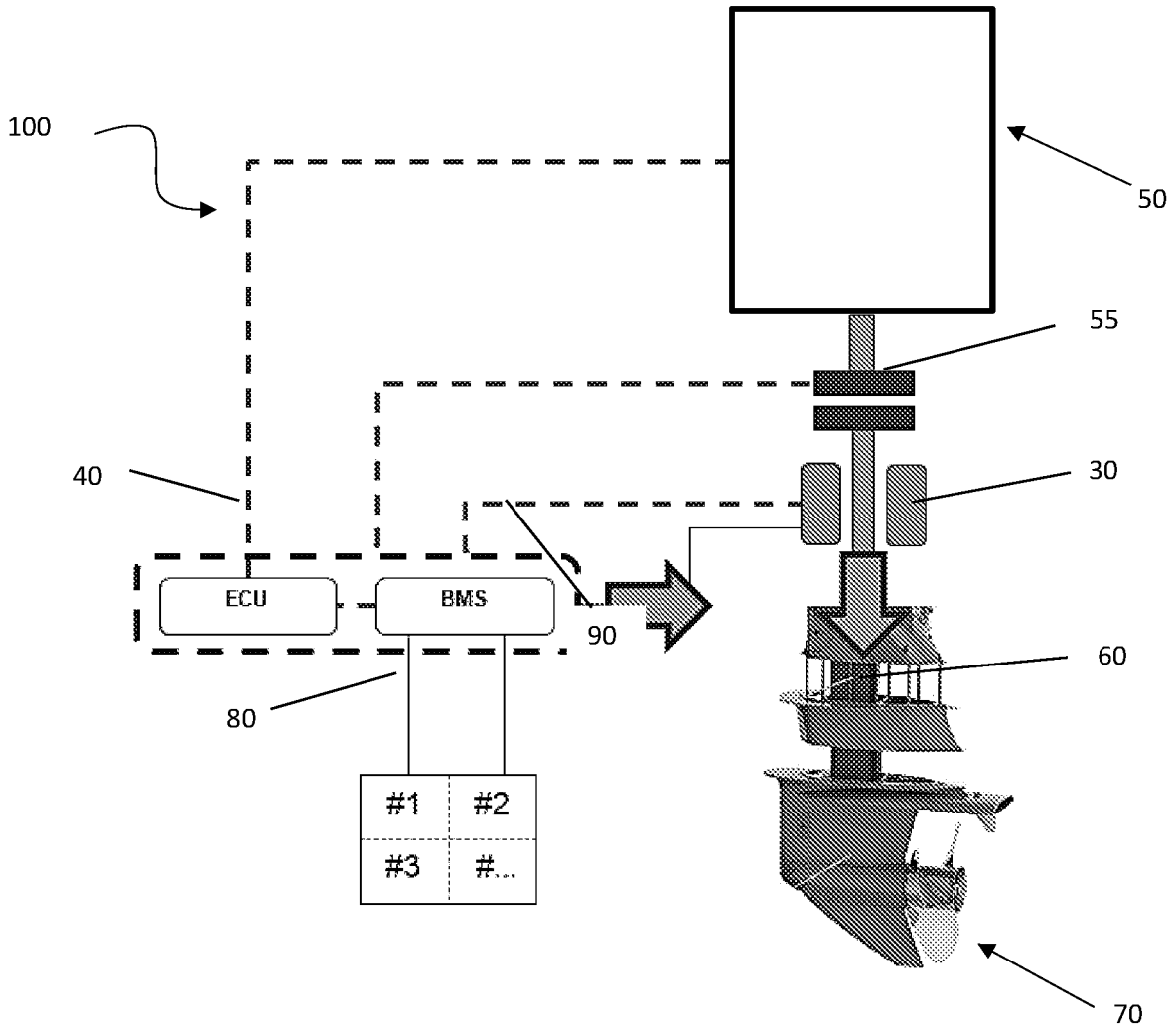

With reference to FIG. 7, a second operating mode of the hybrid propulsion system 100 is described, again, by way of example, in the configuration of FIG. 4. This is an operating mode at a speed significantly lower than the cruising speed in which the propulsion of the pleasure boat 10 is supplied exclusively by the electric motor 30, while the internal combustion engine 50 is completely off. For this reason, this operating mode of propulsion is also called "zero emissions". Once the user has selected this zero-emission operating mode, the control system 40 activates the toothed clutch 55, turns off the internal combustion engine 50 and controls the electric motor 30 as needed.

In summary, the advantages related to the implementation of the present invention are various. The possibility of using two operating modes with a single integrated propulsion system avoids the installation of an auxiliary electric motor, in general and not even in the case of boats intended for trolling, where in general an additional electric motor (or an internal combustion engine) is needed to maintain the low speed required by trolling.

Furthermore, according to the present invention, the combination of the use of a hybrid propulsion system and a position control system based on the signals coming from several gyroscopic sensors and/or triaxial accelerometers, allows the boat to emulate the anchoring position, as well as access to protected areas via zero-emission propulsion modes. It also allows the best performance for trolling by exploiting the low controlled speed obtainable with the electric motor.

Finally, also not negligible is the fact that the electricity consumption required to power the triaxial gyroscopic sensors/accelerometers is lower than the energy required by a position control system based on GPS technology.

In addition to the embodiment of the invention as described above, it should be understood that there are numerous other variants. It should also be understood that these forms of embodiment are only illustrative and do not limit either the scope of the invention, its applications or its possible configurations. On the contrary, although the above description enables the skilled person to implement the present invention according to at least one exemplary embodiment thereof, it should be understood that many variations of the described components are possible without departing from the scope of the invention as defined in the appended claims, which are interpreted literally and/or according to their legal equivalents.

The invention claimed is:

1. A hybrid propulsion system (100) for a pleasure boat (10) provided with a control system (40) of the hybrid propulsion system (100) and of the position of the pleasure boat;

the hybrid propulsion system (100) further comprising:

an internal combustion engine (50) and an electric motor/generator (30, 31, 32) operating in an integrated manner and according to two operating modes managed by the control system (40);

wherein said internal combustion engine (50) is configured to operate in a first operating mode at a cruising speed, and wherein the electric motor/generator (30) is configured to operate in a second operating mode at a lower speed than said cruising speed, in which:

the control system is configured to control the position of the boat by means of signals from a plurality of gyroscopic sensors and/or triaxial accelerometers (20, 21);

and wherein the plurality of gyroscopic sensors and/or triaxial accelerometers is located such that there is at least one gyroscopic sensor and/or one triaxial accelerometer (20) at the bow of the boat (10) and at least one gyroscopic sensor and/or one triaxial accelerometer (21) at the stern of the boat (10), the hybrid propulsion system (100) being characterized by the fact that the control system (40) comprises:

at least one logic block (41, 42) and at least one feedback block (43, 44), the at least one logic block (41, 42) being configured to compare set-point signals (W1, W2) with feedback signals from the at least one feedback block (43, 44), at least one regulator (45, 46) configured to determine the value of a regulating variable (Uy1, Uy2) on the basis of a comparison between the set-point signals (W1, W2) and the feedback signals, and a control unit (47) configured to transform the values of the regulating variable (Uy1, Uy2) into input values (Yx1, Yx2 and Yz1, Yz2) for the electric motor/generator (30, 31, 32):

and wherein the set-point signals (W1, W2) are static or dynamic angular values;

the feedback signals are angular values from at least two of said plurality of gyroscopic sensors and/or triaxial accelerometers (20, 21);

the regulating variable (Uy1, Uy2) is a driving torque, and the input values (Yx1, Yx2 and Yz1, Yz2) are a propulsive thrust according to two directions defined by x and z components of a displacement vector.

2. The hybrid propulsion system (100) according to claim 1, wherein the control system (40) is configured to control the position of the boat (10) emulating an anchoring operation.

3. The hybrid propulsion system (100) according to claim 1, wherein the control system (40) is configured to control the position of the boat (10) performing a trolling operation.

4. The hybrid propulsion system (100) according to claim 1, wherein, the electric motor/generator (30) is unique and the input values also include a pivot angle.

5. The hybrid propulsion system (100) according to claim 1, wherein the control system (40) is configured to control the position of the boat (10) performing a mooring operation in a port or roadstead.

6. The hybrid propulsion system (100) according to claim 1, wherein the set-point signals (W1, W2) are dynamic and angular values, and are calculated from a mooring model (48) having as input the direction of the wind.

7. The hybrid propulsion system (100) according to claim 1, wherein the plurality of gyroscopic sensors and/or triaxial accelerometers (20, 21) is configured to operate in a wi-fi operating mode.

8. The hybrid propulsion system (100) according to claim 1, further comprising at least one wind angle sensor.

9. The hybrid propulsion system (100) according to claim 1, wherein the hybrid propulsion system (100) is installed in an outboard position.

* * * * *